United States Patent [19]

Yamazawa

[11] 4,444,138

[45] Apr. 24, 1984

[54] THREAD CONTROLLING MECHANISM FOR MULTIPLE NEEDLE SEWING MACHINE

[75] Inventor: Masayuki Yamazawa, Kariya, Japan

[73] Assignee: Aisin Seiki Kabushiki Kaisha, Kariya, Japan

[21] Appl. No.: 490,894

[22] Filed: May 2, 1983

[30] Foreign Application Priority Data

May 7, 1982 [JP] Japan ..... 57-076362

[51] Int. Cl.[3] ..... D05B 49/00

[52] U.S. Cl. ..... 112/241; 112/163; 112/221

[58] Field of Search ..... 112/241, 242, 221, 79 R, 112/79 A, 163, 167, 165, 98

[56] References Cited

U.S. PATENT DOCUMENTS

| | | | |
|---|---|---|---|
| 1,266,036 | 5/1918 | Molyneux | 112/241 X |
| 1,397,507 | 11/1921 | Gatchell | 112/241 |
| 2,556,068 | 6/1951 | Crawford | 112/79 R |
| 2,832,301 | 4/1958 | Wear | 112/79 R |
| 4,075,958 | 2/1978 | Sacchetti | 112/221 X |
| 4,295,433 | 10/1981 | Desprez et al. | 112/241 |

*Primary Examiner*—H. Hampton Hunter
*Attorney, Agent, or Firm*—Sughrue, Mion, Zinn, Macpeak & Seas

[57] ABSTRACT

A sewing machine provided with three selectively operable needle bars and a take-up lever mounted for vertical oscillating movement is provided with a selectively operatable thread clamping device for selectively clamping any two of the three threads associated with the respective needle bars in a stationary position while permitting the third thread to follow the oscillating movement of the take-up lever during reciprocation of the selected needle bar. The thread clamping device is comprised of two flexible plates disposed between two stationary plates secured to the sewing machine arm. The four plates are provided with vertically aligned slots to accomodate the oscillating movement of the take-up lever. A moveable plate having cam surfaces thereon is mounted for reciprocating movement on the sewing machine arm with the cam surfaces operably engageable with the upper ends of the two flexible plates for selectively clamping any two of the three threads passing through the respective passages between the plates.

4 Claims, 10 Drawing Figures

FIG. 4
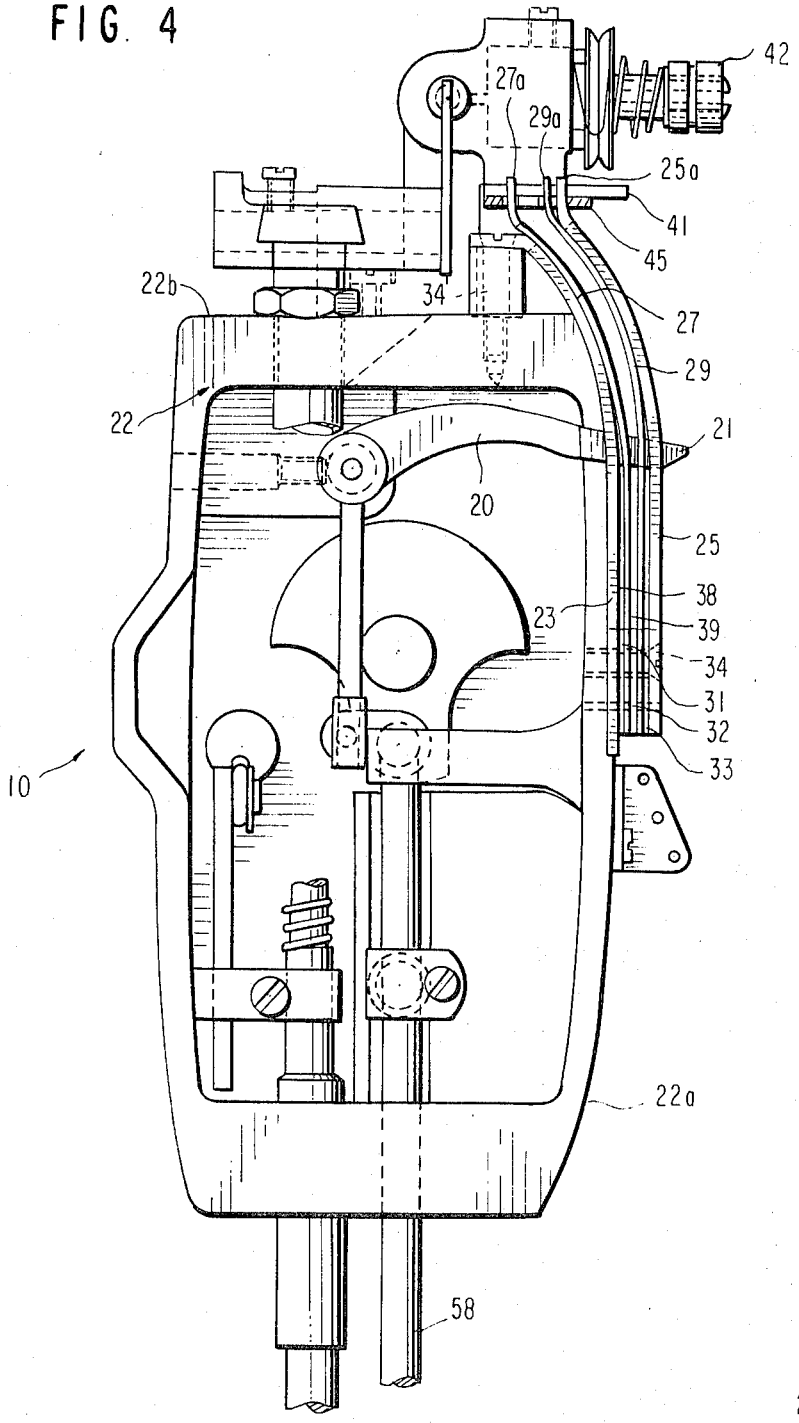
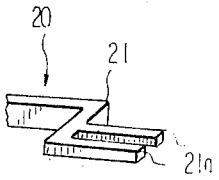
FIG. 5

THREAD CONTROLLING MECHANISM FOR MULTIPLE NEEDLE SEWING MACHINE

BACKGROUND OF THE INVENTION

The present invention is directed to a selectively operable multiple needle sewing machine and more specifically to a thread clamping device for selectively clamping the threads leading to the inoperative needles to prevent entanglement of said threads with the thread leading to the operative needle upon oscillation of the thread take-up lever.

In the conventional selectively operable multiple needle sewing machine 10 shown in FIG. 1, any one of the three needles 11, 12, and 13, may be selected for reciprocation by any suitable means (not shown) while the other two needles remain inactive. The threads 14, 15, and 16, leading to the needles 11, 12 and 13, respectively, pass through holes 17, 18, and 19 formed in a common take-up lever 20. The holes 17, 18, and 19, are each formed in a separate extension of the common take-up lever 20, thereby substantially increasing the mass of the oscillating take-up lever 20. As a result of the increased mass of the oscillating take-up lever 20, it is impossible to operate the sewing machine at high speeds. Furthermore, even though only a single needle is selectively operated with a reciprocating motion, all of the threads are simultaneously moved in a vertical direction in accordance with the oscillating movement of the take-up lever 20 during a sewing operation. Thus, the three threads tend to become tangled with each other during the operation of the sewing machine.

SUMMARY OF THE INVENTION

The present invention provides a new and improved selectively operable multiple needle sewing machine having an improved thread control system which obviates the afore-mentioned disadvantages.

The present invention provides a new and improved selectively operable multiple needle sewing machine having selectively operable thread clamping means for clamping the threads leading to the inoperative needles in a fixed position adjacent the top dead center position of the oscillating take-up lever so as to prevent the vertical movement of the threads leading to the inoperative needles upon oscillation of the take-up lever.

The present invention provides a new and improved sewing machine having three selectively operable needles mounted for reciprocation in the free end of the sewing machine arm, a take-up lever mounted for vertical oscillating movement in said arm and adapted to be operatively engaged with three threads being directed to said needles, first and second stationary plates secured together in superimposed parallel spaced relation on said arm with each plate having an elongated slot through which said take-up lever extends, first and second flexible plates secured at the lower end thereof between said first and second stationary plates and having elongated slots therethrough aligned with the slots in said first and second stationary plates through which said take-up lever extends, spacer means disposed between the lower end portions of said first and second flexible plates and between the lower end portions of said first and second flexible plates and said first and second stationary plates to define first, second, and third thread passages between said plates for said three yarns, respectively, whereby upon vertical oscillating movement of said take-up means the threads can be moved vertically in said thread passages between said plates, and cam means operatively engaging the upper end portion of said first and second flexible plates for selectively moving the upper end portions of said first and second flexible plates into and out of engagement with each other and said first and second stationary plates for simultaneously clamping two selected threads adjacent the top dead center position of said take-up lever when all of said threads have been lifted to said position by said take-up lever.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 4 is a partial front elevational view of the thread clamping device according to the present invention.

FIG. 5 is a perspective detailed view showing the thread engaging portion of the take-up lever according to the present invention.

DETAILED DESCRIPTION OF THE INVENTION

Figure 1:
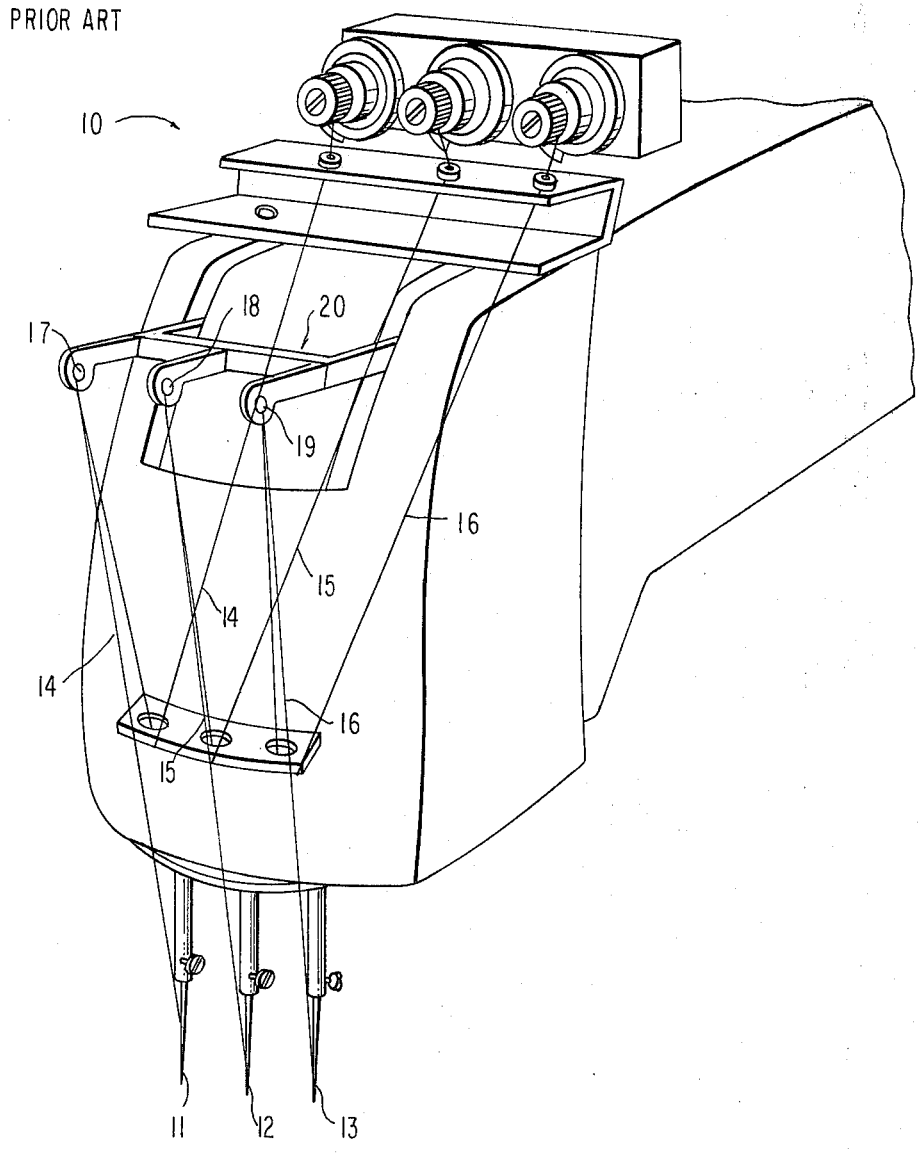
FIG. 1 PRIOR ART
FIG. 1 is a perspective view of the head of a conventional selectively operable multiple needle sewing machine having a common take-up lever.

The thread clamping device according to the present invention is shown in FIGS. 2–10, inclusive. The sewing machine 10 is provided with a take-up lever 20 which is mounted for oscillating movement in a vertical plane and which is driven by conventional mechanisms within the sewing machine arm 22. The sewing machine 10 is also provided with three needles 58, 59, and 60, which are mounted for reciprocation within the sewing machine arm and which may be selectively placed into and out of operation by a conventional mechanism which is not shown since it does not constitute a part of the present invention. The distal end portion of the take-up lever 20 is provided with thread pick-up means 21 having a forked portion providing two spaced apart parallel arms 21*a*, 21*a*, as best seen in FIG. 5.

Figure 2:
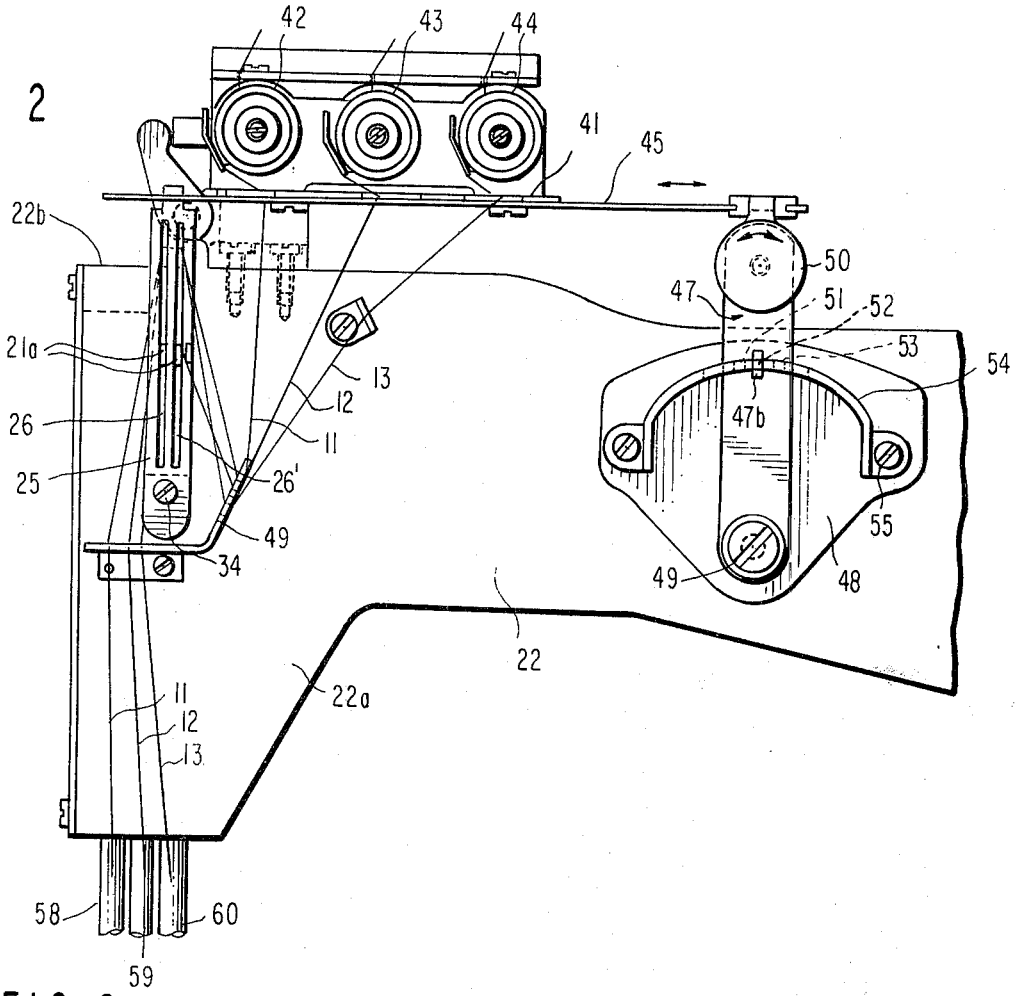
FIG. 2 is a partial side elevation view of a sewing machine head according to the present invention showing the selectively operable thread clamping device.
Figure 8:
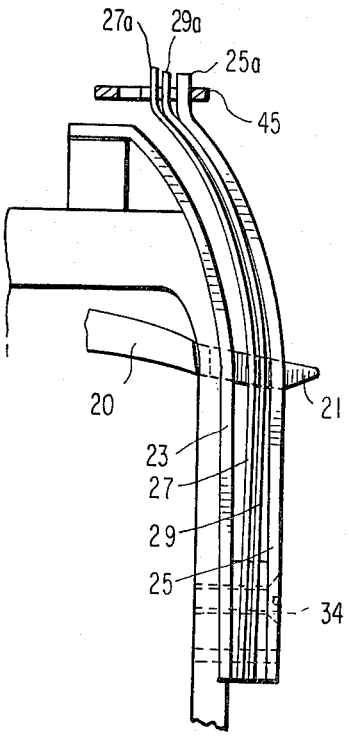
FIG. 8 is a partial front elevation view showing the thread clamping mechanism in a first position.
Figure 9:
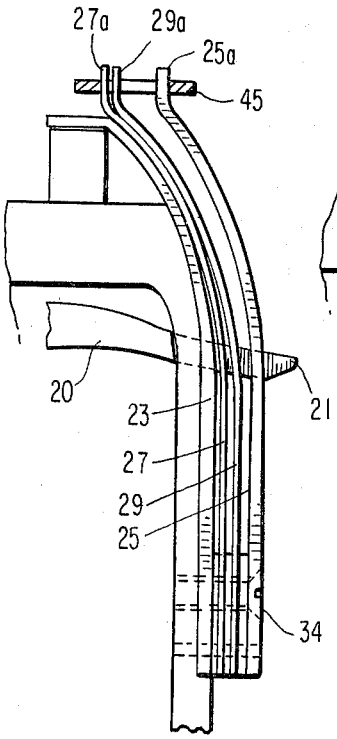
FIG. 9 is a partial front elevation view showing the thread clamping mechanism in a second position.

As best seen in FIG. 4, a first stationary plate 23 is secured to the front side 22*a* of the sewing machine arm 22 by means of screws 34 and 34'. A second stationary plate 25, having a configuration similar to that of the first stationary plate 23, is also secured to the front side 22*a* of the arm 22 in superimposed spaced relation to the stationary plate 23 by means of the screw 34. The first and second stationary plates are slightly curved so as to be approximately similar to the locus of movement of the pick-up means 21 on the free end of the take-up lever 20. First and second flexible plates or leaf springs 27 and 29, having a configuration similar to that of the stationary plates 23 and 25, are located intermediate the stationary plates 23 and 25. The first and second flexible plates 27 and 29 have a curvature similar to that of the stationary plates 23 and 25 and are disposed in spaced relation to each other and the stationary plates 23 and 25 by means of three spacing members 31, 32, and 33. The screw 34 extends through all four plates and the three spacers to secure the plates and spacers to the arm as shown in FIG. 4. The spacers 31, 32, and 33, each define a first clearance 38, a second clearance 39, and a third clearance 40, respectively, between the first stationary plate 23 and the first flexible plate 27, between the first flexible plate 27 and the second flexible plate 29, and between the second flexible plate 29 and the second stationary plate 25. The upper end portion 27*a* of the first flexible plate 27 and the upper end portion 29*a* of the second flexible plate 29 are normally maintained in freely moveable condition. As best seen in FIG. 2, the second stationary plate 25 is provided with a pair of elongated vertically extending slots 26 and 26'. The other stationary plate 23 and the two flexible plates 27 and 29 are also provided with similar slots which are disposed in alignment with the slots 26 and 26' in the stationary plate 25. These slots define a vertical path for the two projections 21*a*, 21*a*, on the pick-up means 21 of the take-up lever 20.

A flat plate 41 carrying three thread tension regulators 42, 43 and 44, is secured to the upper surface 22*b* of the arm 22. Three sewing theads 11, 12 and 13 are directed from suitable supply means (not shown) through the three thread tension regulators 42, 43, and 44, respectively, through respective apertures in a thread guide plate 19, through the clearances 38, 39, and 40, respectively, over the projections 21*a*, 21*a*, through respective openings in the thread guide plate 19 to the needles secured to the needle bars 58, 59 and 60, respectively.

Figure 3:
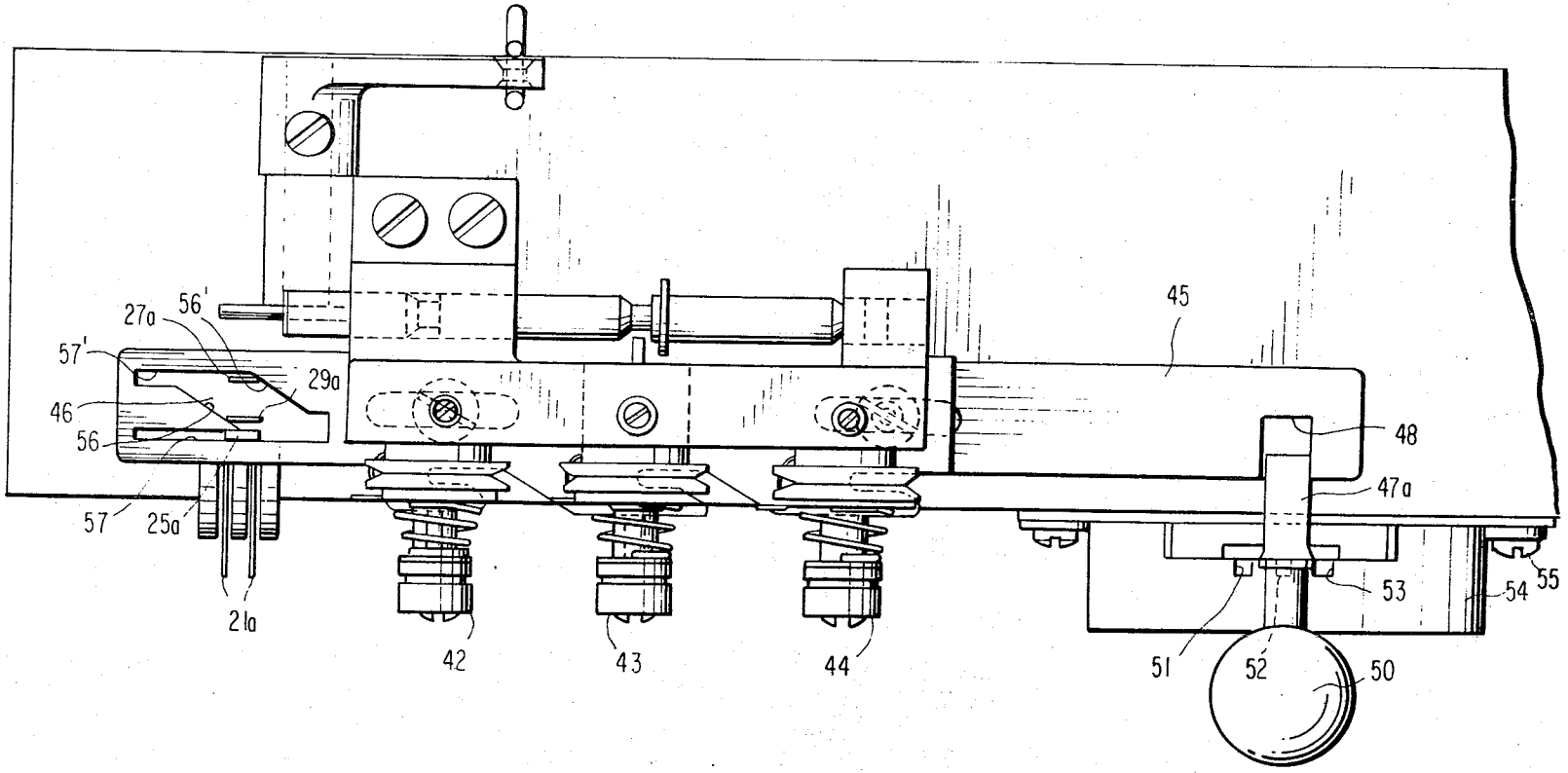
FIG. 3 is a top plan view of the thread clamping device shown in FIG. 2.
Figure 6:
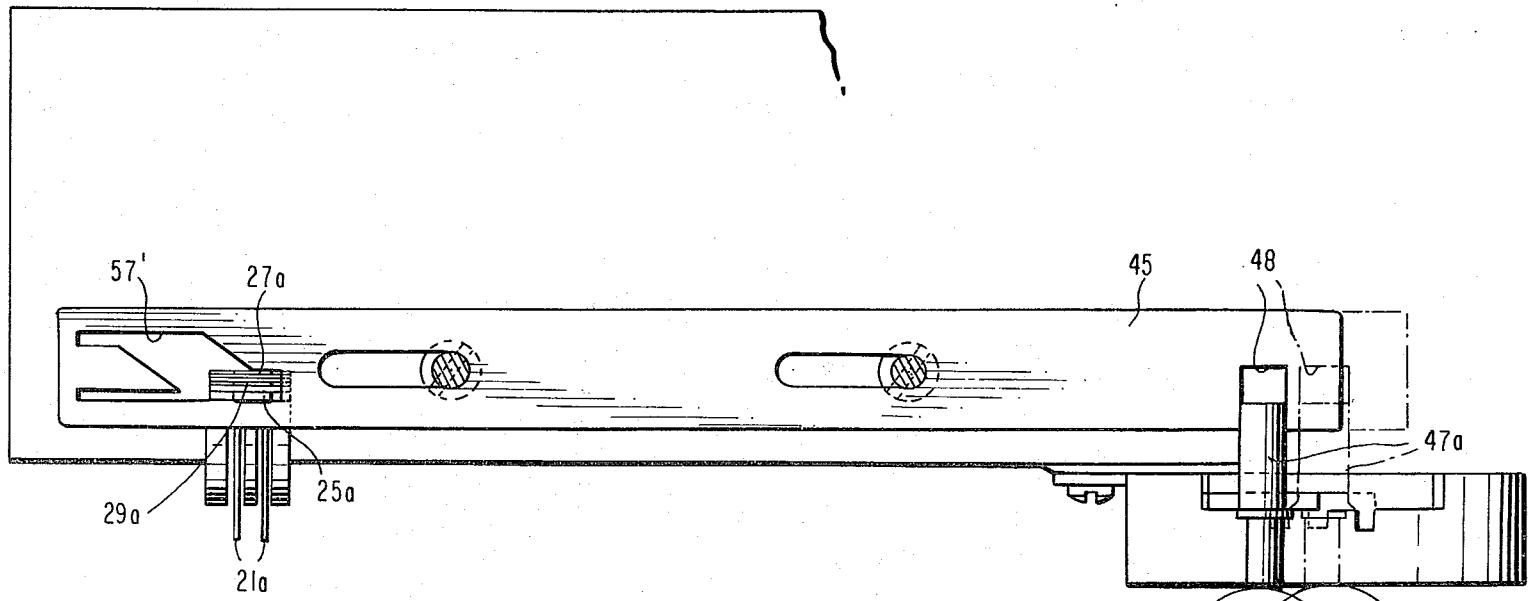
FIG. 6 is a partial top plan view, partly in section, showing the cam means of the thread clamping mechanism according to the present invention in one extreme position.
Figure 7:
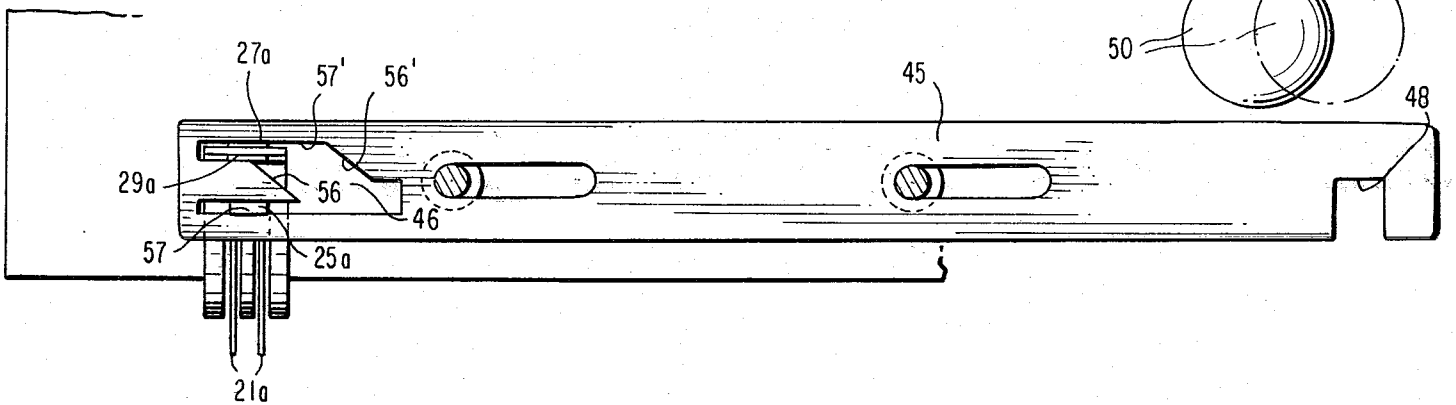
FIG. 7 is a partial top plan view showing the cam means for the thread clamping mechanism according to the present invention in the other extreme position.

An actuating plate 45 is slidably mounted on the undersurface of the plate 41 for longitudinal reciprocating movement in the direction of the arrows as shown in FIG. 2. The plate 45 is held in sliding engagement with the plate 41 by means of screws and washers extending through elongated slots in the plate 45 as best seen in FIG. 3. An opening 46 is provided at the left end portion of the plate 45 as viewed in FIG. 3 so as to receive the upper end portions 25*a* of the second stationary plate 25, the upper end portion 27*a* of the first flexible plate 27, and the upper portion 29*a* of the second flexible plate 29.

The plate 45 is further provided at the right end portion thereof, as viewed in FIG. 3, with a cutout portion 48 into which extends a projection 47*a* on the upper end of a flexible lever 47. The lower end portion of lever 47 is pivotably mounted on a frame member 48 by means of a pivot screw 49. The frame 48 is connected to the front side of the arm 22 and is provided with an arc shaped member 54 secured to the front surface thereof by means of screws 55 so that the arc shaped member is spaced from the frame 48 at least along the central portion thereof. The arc shaped member is provided with three equally spaced notches 51, 52, and 53. A projection 47*b* is secured to the lever 47 for selective engagement in one of the notches. A knob 50 is secured to the other end of the lever 47 for pivotally moving the lever 47 in the direction of the arrows shown on the knob 50 in FIG. 2. In order to move the lever 47 it is only necessary to push the knob 50 toward the sewing machine arm and the flexibility of the lever 47 will allow projection 47*b* to clear the notches 51, 52, and 53. After the lever 47 has been pivoted to align projection 47*b* with the desired notch the knob can be released and the inherent elasticity of the flexible lever 47 will engage the projection in the desired notch to lock the slidable plate 45 in the desired position.

A pair of opposed diagonal cam surfaces 56 and 56' are provided along the edges of the opening 46 and a pair of opposed straight edges 57 and 57' are disposed parallel to each other in the direction of the length of the slidable plate 45.

Prior to initiating a sewing operation, the take-up lever 20 will be positioned at the bottom dead center position and the three threads 11, 12, and 13, can be passed through the clearances 38, 39, and 40, respectively over the projections 21*a* on the take-up lever.

Figure 10:
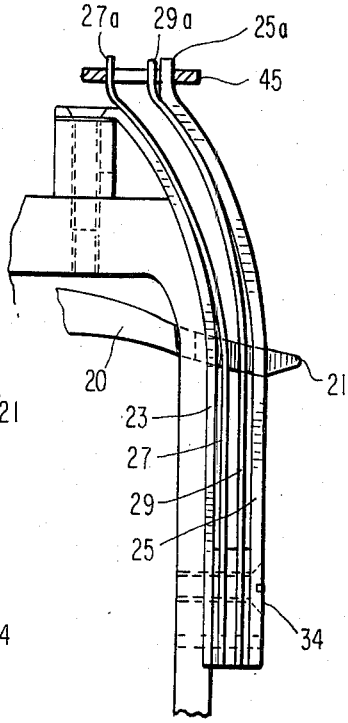
FIG. 10 is a partial front elevation view showing the thread clamping mechanism in a third position.

Upon upward movement of the take-up lever 20 the three threads 11, 12 and 13, are raised in their respective clearances. Under the conditions as illustrated in FIGS. 2, 3, and 10, with projection 47*b* on the lever 47 disposed in the center notch 52 and the first and second flexible plates 27 and 29 being biased into engagement with the first and second stationary plates respectively due to the inherent resiliency of the flexible plates the thread 11 will be caught between the first stationary plate 23 and the first flexible plate 27 and the thread 13 will be caught between the second flexible plate 29 and the second stationary plate 25 leaving only the thread 12 free for movement in the center clearance 39. Thus, with the center needle bar 59 being operatively reciprocated the thread 12 will be free for movement past the tensioning means, the thread guides and the take-up lever while the other two threads 11 and 13 which are directed to the needles associated with the inoperative needle bars 58 and 60 are clamped in a fixed position.

When it is desired to reciprocate the needle bar 60, it is necessary to free the thread 13 for movement while clamping the other two threads 11 and 12. In order to accomplish this, the knob 50 is pushed toward the arm 22 of the sewing machine to disengage the projection 47*b* from the notch 52 and rotate the lever 47 in the clock-wise direction as viewed in FIG. 2. This will cause the plate 45 to move to the right as viewed in FIG. 7 to move the upper end 29*a* of the second flexible plate into engagement with the upper end 27*a* of the first flexible plate while maintaining the first flexible plate in engagement with the first stationary plate 23. Upon release of the knob 50 the projection 47*b* will move into engagement with the notch 53 to thereby maintain the plates in the relative positions shown in FIG. 9. Thus the thread 13 which moves in the clearance 40 will be free for operative movement in association with the needle bar 60.

When it is desired to selectively reciprocate the needle bar 58 the thread 11 must be freed while the threads 12 and 13 are clamped in a fixed upper position. This is accomplished by moving the lever 47 counter-clockwise as viewed in FIG. 2 to shift the plate 45 to the left into the position shown in FIG. 6. Upon locking the lever 47 in the extreme left hand position by engagement of the projection 47*b* in the notch 51 the plates will be maintained in the positions shown in FIG. 8 so that the thread 11 which operates in the clearance 38 will be free for operative movement to carry out a sewing operation.

While the invention has been particularly shown and described with reference to a preferred embodiment thereof, it will be understood by those in the art that various changes in form and details may be made therein without departing from the spirit and scope of the invention.

What is claimed is:

1. A sewing machine comprising three selectively operable needle bars mounted for reciprocation in the free end of the sewing machine arm, a take-up lever mounted for vertical oscillating movement in said arm and adapted to be operably engaged with three threads leading to needles on said needle bars, first and second stationary plates secured together and superimposed in parallel spaced relation on said arm with each plate having elongated slot means through which said take-up lever extends, first and second flexible plates secured at the lower end thereof between said first and second stationary plates and having elongated slot means therethrough aligned with the slot means in said first and second stationary plates through which said take-up lever extends, spacer means disposed between the lower end portion of said first and second flexible plates and between the lower end portions of said first and second flexible plates and said first and second stationary plates to define first, second and third thread passages between said plates for said three yarns, respectively, whereby upon vertical oscillating movement of said take-up means said threads can be moved vertically in said thread passages between said plates, and operating means for selectively controlling the position of the upper end portions of said first and second flexible plates for selectively clamping any two of said threads in the vicinity of the top dead center position of said take-up lever when all of said threads have been lifted to said position by said take-up lever.

2. A sewing machine as set forth in claim 1 wherein said operating means is comprised of a slidable member having cam means at one end thereof in operative engagement with said upper end portions of said flexible plates for selectively moving said flexible plates toward and away from each other and said stationary plates for selectively clamping any two of said threads in said position.

3. A sewing machine as set forth in claim 2 wherein said cam means is comprised of an opening in one end of said slidable member receiving the upper end portions of said flexible plates with two opposed edges of said opening being disposed parallel to each other at an angle to the direction of movement of said moveable member for engaging and moving said flexible plates upon reciprocating movement of said moveable member and further comprising lever means operatively connected to said moveable member and means for selectively locking said lever means in three selected positions related to the specific needle bars selected for operation.

4. A sewing machine as set forth in claim 1 wherein said slot means are comprised of two parallel elongated vertically extended slots and said take-up lever includes a pair of pick-up arms extending through said slots for engagement with said threads.

* * * * *